US007281767B2

(12) United States Patent
Gaylord et al.

(10) Patent No.: US 7,281,767 B2
(45) Date of Patent: Oct. 16, 2007

(54) LOUNGE CHAIR WITH MOVABLE ARMS

(75) Inventors: Robert A. Gaylord, Virginia Beach, VA (US); Oliver Wang, East Kowloon (HK)

(73) Assignee: Agio International Company, Limited, Kowloon (HK)

( * ) Notice: Subject to any disclaimer, the term of this patent is extended or adjusted under 35 U.S.C. 154(b) by 0 days.

(21) Appl. No.: 11/339,464

(22) Filed: Jan. 25, 2006

(65) Prior Publication Data

US 2006/0175886 A1 Aug. 10, 2006

Related U.S. Application Data

(63) Continuation of application No. 10/722,922, filed on Nov. 26, 2003, now Pat. No. 7,021,717.

(51) Int. Cl.
*A47C 7/54* (2006.01)

(52) U.S. Cl. ..... 297/411.33; 297/115

(58) Field of Classification Search ..... 297/115, 297/411.33, 411.35, 411.36; 5/430
See application file for complete search history.

(56) References Cited

U.S. PATENT DOCUMENTS

| | | | | | |
|---|---|---|---|---|---|
| 598,735 | A | * | 2/1898 | Megins | 5/430 |
| 1,185,181 | A | | 5/1916 | Collins | |
| 1,198,009 | A | * | 9/1916 | Cooper | 5/430 |
| 1,399,744 | A | * | 12/1921 | Brophy | 297/411.33 |
| 2,024,170 | A | | 12/1935 | Kruse | |
| 2,614,612 | A | | 10/1952 | Wogomon | |
| 2,817,855 | A | * | 12/1957 | Pratt | 5/430 |
| 3,021,534 | A | * | 2/1962 | Hausted | 5/430 |
| 3,056,975 | A | * | 10/1962 | Murcott | 5/430 |
| 3,093,839 | A | * | 6/1963 | Higgins | 5/429 |
| 3,679,257 | A | | 7/1972 | Jacuzzi et al. | |
| 3,737,926 | A | | 6/1973 | Hermanson | |
| 4,252,371 | A | | 2/1981 | Lehnen | |
| 4,441,756 | A | | 4/1984 | Liou | |
| 4,955,517 | A | * | 9/1990 | Maresca | 297/411.36 |
| 5,062,676 | A | | 11/1991 | Mars | |
| 5,230,113 | A | * | 7/1993 | Foster et al. | 5/608 |
| 5,547,245 | A | | 8/1996 | Knouse | |
| 5,944,384 | A | | 8/1999 | Patterson | |
| 6,082,820 | A | | 7/2000 | Jeng | |
| 6,109,685 | A | | 8/2000 | Lindsey et al. | |
| 6,213,555 | B1 | | 4/2001 | Sulpizio | |
| 6,293,624 | B1 | | 9/2001 | Gaylord | |
| 6,585,323 | B2 | | 7/2003 | Gaylord | |
| 6,761,397 | B1 | | 7/2004 | Tseng | |

* cited by examiner

*Primary Examiner*—Peter R. Brown
(74) *Attorney, Agent, or Firm*—Williams Mullen; M. Bruce Harper

(57) ABSTRACT

A lounge chair having movable armrests. The lounge chair comprises a seat, a back, legs and armrests. The armrests may be placed in a raised position for use by the occupant or may be swing down to provide more room or to allow the occupant to easily exit the lounge chair. The armrests are preferably attached to each other such that moving one arm to the lowered position simultaneously moved the other arm to the lowered position.

22 Claims, 5 Drawing Sheets

LOUNGE CHAIR WITH MOVABLE ARMS

CROSS REFERENCE TO RELATED APPLICATION

The present application is a continuation of "Lounge Chair with Movable Anns," U.S. application Ser. No. 10/722,922, filed Nov. 26, 2003, now U.S. Pat. No. 7,021,717, which is hereby incorporated by reference thereto.

1. Field of the Invention

The disclosed invention relates to lounge chairs. In particular, the present invention relates to lounge chairs which have simultaneously movable arms.

2. Description of Related Art

Lounge chairs, in many different forms have been used for quite some time. Lounge chairs without arms are shown in U.S. Pat. Nos. 6,585,323, 6,293,624, 6,213,555, 6,109,685 and 3,737,926. These chairs generally have a flat portion for the user's legs and a fixed or adjustable portion for the user's back and head. The chairs have fixed or foldable legs and may include wheels for ease of relocation of the chair. The chairs are covered with slats of wood, plastic, vinyl or fabric or by a solid piece of these materials. Other lounge chairs include arms such as those shown in U.S. Pat. Nos. 6,082,820, 4,441,756, 4,252,371, 2,614,612 and 1,185,181. These chairs are similar to those without arms discussed previously but also include arms. In some examples, the arms are rigid; in others, the arms fold as the chair is collapsed for transport or storage.

These prior art lounge chairs lack an arm structure which may be moved by an occupant of the chair. Such a structure is desirable to facilitate exiting the chair. Moving the arms also allows different occupants to configure the chair to their personal tastes, whether they prefer a lounge chair with arms or without. None of the above inventions and patents, taken either singly or in combination, is seen to describe the present invention as claimed.

Accordingly, it is an object of the present invention to provide a lounge chair which includes arms which are movable.

It is another object of the present invention to provide a lounge chair with movable arms to facilitate entering or exiting the chair.

It is another object of the present invention to provide a lounge chair with movable arms which may be moved simultaneously with a single motion.

It is yet a further object of the present invention to provide a lounge chair which is convenient and easy to use.

Finally, it is an object of the present invention to accomplish the foregoing objectives in a simple and cost effective manner.

SUMMARY OF THE INVENTION

A lounge chair having movable arms includes a seat, adjustable back, legs and at least one armrest which may be raised or lowered as needed or desired, independently of the orientation of the back. The seat is preferably horizontally oriented, adjustable and covered in part by material. The back is preferably adjustable between a vertical orientation and a horizontal orientation and is covered in part by material similar to the seat. Both are suspended by a frame and the legs. The armrest or armrests preferably have an upper horizontal member; and at least one vertical support member which may be connected to the seat. If both armrests are collapsible, a horizontal member may connect the armrests to facilitate collapsing or raising the armrests.

In the preferred embodiment, a stop element is provided to limit motion of the armrest or armrests beyond a desired orientation in either or both directions.

| Element List | |
|---|---|
| 10 | frame |
| 20 | back portion |
| 22 | seat portion |
| 24 | legs |
| 26 | armrests |
| 28 | support beam |
| 30 | vertical element |
| 32 | horizontal element |
| 34 | horizontal bar |
| 36 | stops |
| 38 | bolt |
| 40 | bolt |

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating general principles of embodiments of the invention.

The present invention provides a lounge chair which has movable armrests for ease of use. The chair includes a frame, seat portion, back portion, armrests and legs. The armrests can be moved between a position which is elevated above the seat portion and a position which is preferably substantially even with the seat portion. This motion is achieved independently of the orientation of the seat portion or the back portion. This allows a user of the lounge chair to determine whether they wish to use the armrests or not and provides a convenient orientation for the armrests when they are not desired. Further, by lowering the armrests, egress from the chair is facilitated. Preferably, both armrests may be lowered by a single motion.

Figure 1:
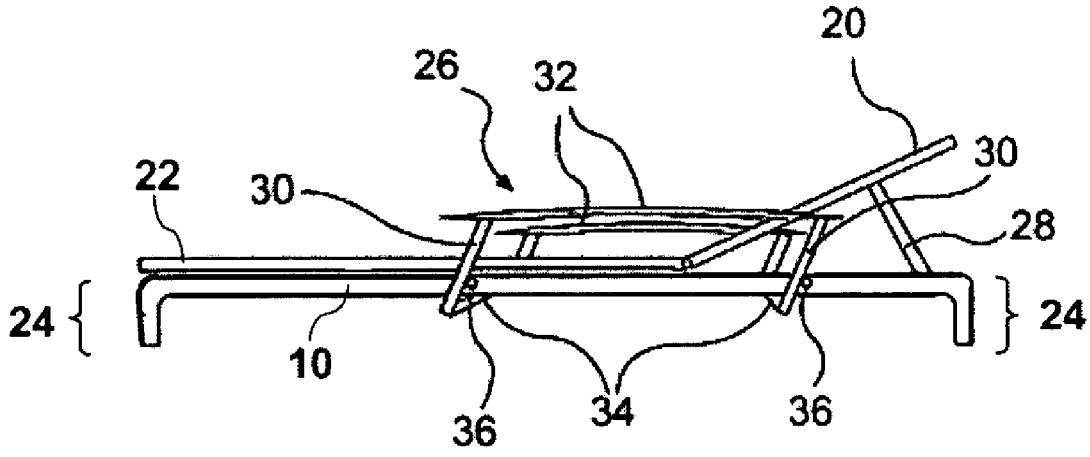
FIG. 1 shows the preferred embodiment of the present invention with the armrests raised.
Figure 2:
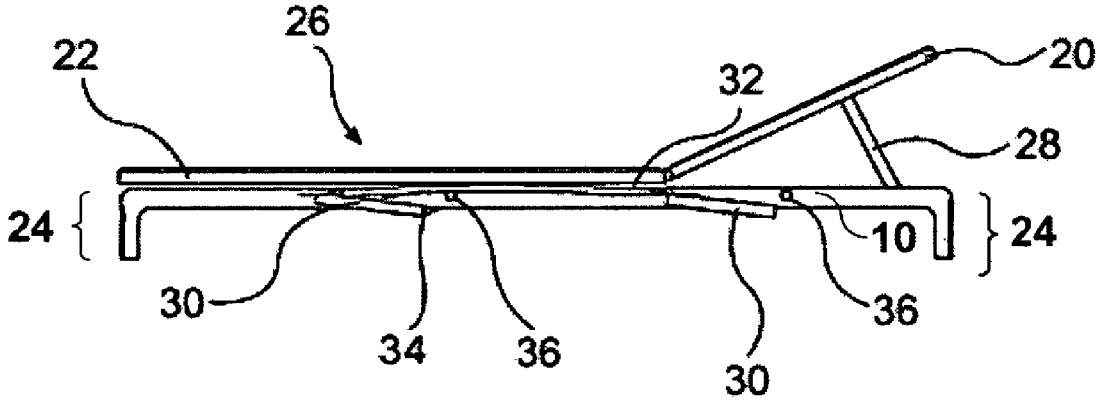
FIG. 2 shows the preferred embodiment of the present invention with the armrests lowered.

The lounge chair, shown in FIGS. 1 and 2, includes a frame 10, back portion 20, a seat portion 22, legs 24 and armrests 26. The back portion 20 is preferably adjustable between at least a generally vertical position and a generally horizontal position. The adjustment may be made by any means known in the art such as a support beam 28 as shown.

The back portion 20 may also have a fixed position, either in an upright, vertical position or in a horizontal position. The seat portion 22 preferably includes a horizontal element and may be entirely horizontal. Alternatively, the seat portion 22 may include a vertical portion for supporting the user's legs. If desired, the seat portion 22 may be adjustable to allow for different orientations of the user's legs and/or feet.

The frame 10, seat portion 22, and back portion 20 are formed by any means known in the art for lounge chairs. Generally, the seat portion 22 and back portion 20 are constructed from heavy-duty, weather resistant materials. The construction may include a tubular frame 10, while seat portion 22 and back portion 20 may be covered with nylon, fabric or plastic straps stretched across portions of frame 10; those in the field will recognize that frame 10 may be of a variety of embodiments consistent with parameters of the present invention. Alternatively, sheets of material may be attached to frame 10 to provide support for the user. A wooden embodiment of frame 10 may have rigid slats disposed within frame 10.

The seat portion 22 and back portion 20 are preferably supported by legs 24 and frame 10. The legs may be constructed from the same material as frame 10 or may be different. The legs 24 may include wheels (see FIGS. 3 and 4) to facilitate moving the lounge chair or may fold for ease of storage.

Figure 3:
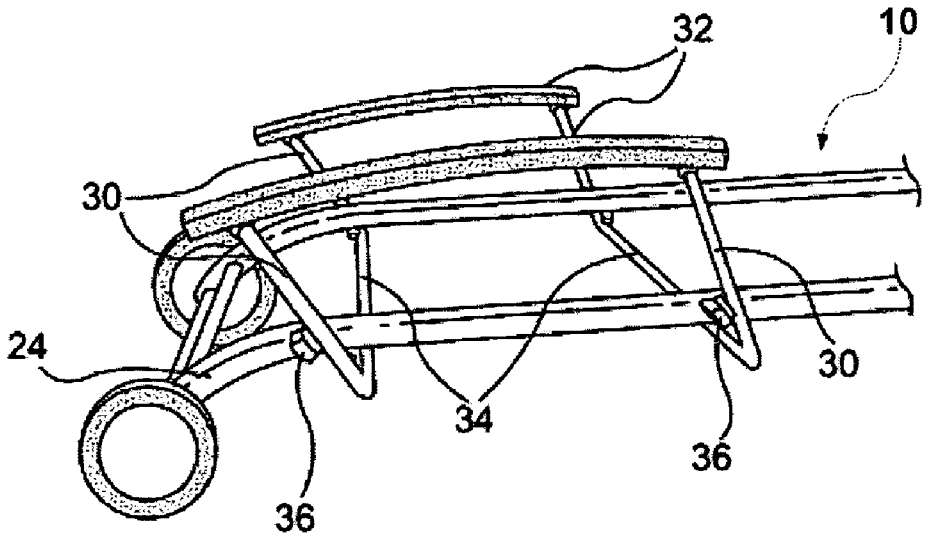
FIG. 3 is an exploded view of the preferred armrest assembly with the armrests raised.
Figure 4:
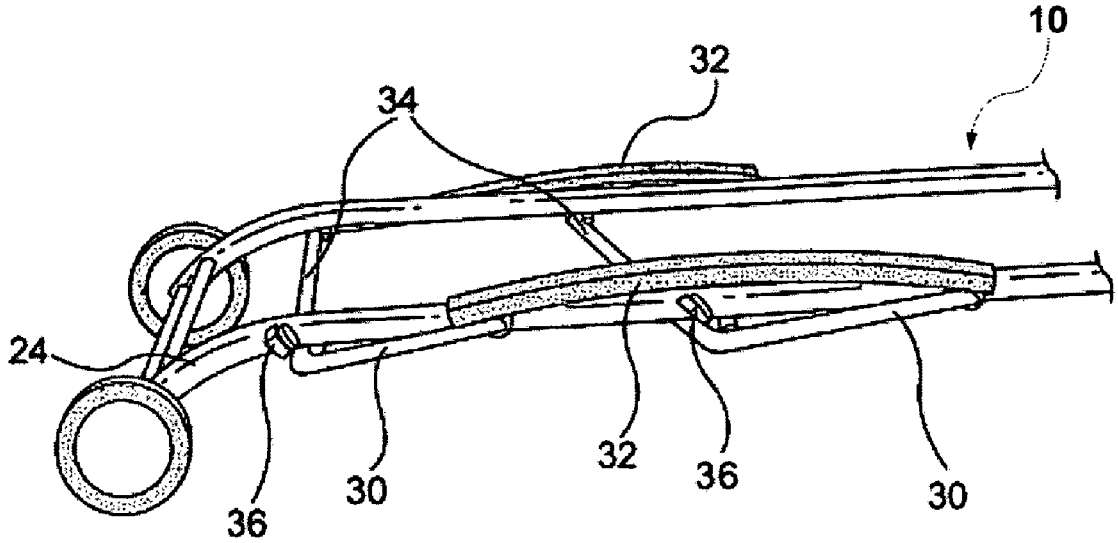
FIG. 4 is an exploded view of the preferred armrest assembly with the armrests lowered.

The armrests 26 consist of vertical elements 30 which support a horizontal element 32 as shown in more detail in FIGS. 3 and 4. The upper ends of the vertical elements 30 are preferably pivotally connected (see detail of preferred pivot construction in FIG. 7) to the horizontal element 32 to allow rotational movement between the horizontal 32 and vertical elements 30. The lower ends of the vertical elements are preferably connected to horizontal bar 34 and pivotally connected (see detail of the preferred pivot construction in FIG. 6) to the seat portion 22. The horizontal bar 34 connects the lower ends of vertical elements 32 on opposite sides of the seat portion 22. Thus, when one armrest 26 is moved, the other armrest is also moved. In the preferred embodiment, horizontal bars 34 connect both pairs of vertical elements 32 as shown in FIGS. 1-4. The armrests 26 are preferably constructed from a heavy-duty weather resistant material like the frame and may be from the same material or a different material.

To limit the movement of the armrests 26, one or more stops 36 may be used. In FIGS. 1-4, two stops 36 are used on each side of the lounge chair. As shown in FIGS. 1 and 3, when the armrest 26 is in the upright position, the vertical elements 30 rest against the stops 36. The stops 36 maintain the armrests 26 in an upright position for use by the lounge chair's occupant. FIGS. 2 and 4 show the armrests 26 in the lowered position. To achieve this configuration, the armrests 26 are moved forward, away from the stops 36. Preferably, the armrests are connected by the horizontal bar 34 such that one single motion moves both armrests into the desired configuration. Preferably, the horizontal element 32 of the armrests is held in the desired lowered position by at least one of the stops 36 as is shown in FIG. 2. A configuration using a horizontal bar 34 to connect the armrests 26 may require only one stop 36 to control the movement of the entire armrest 26. The stops 36 are connected to the frame 10, preferably the portion of frame 10 supporting seat portion 22 and are preferably constructed using a shock absorbing material such as rubber or a plastic.

Figure 5:
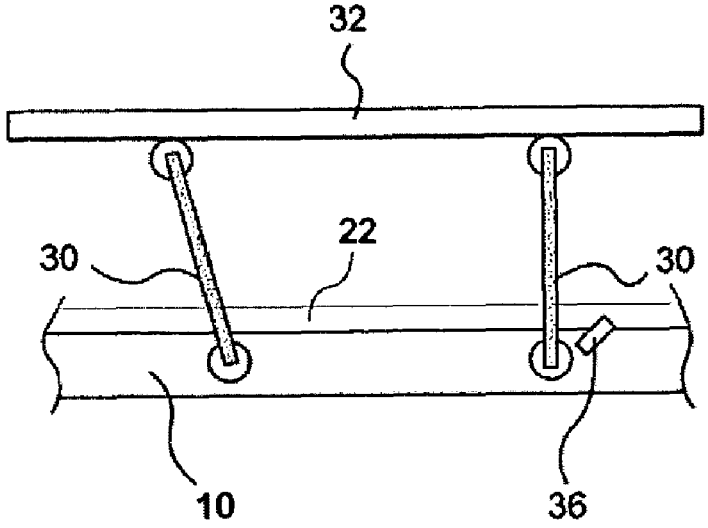
FIG. 5 is a detailed view of the armrest assembly of the preferred embodiment of the present invention.
Figure 6:
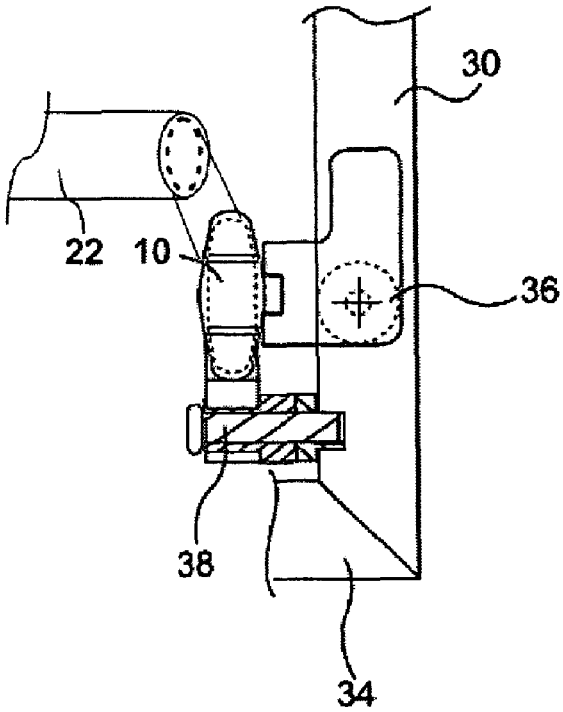
FIG. 6 is a detailed view of a portion of the armrest of the preferred embodiment of the present invention.
Figure 7:
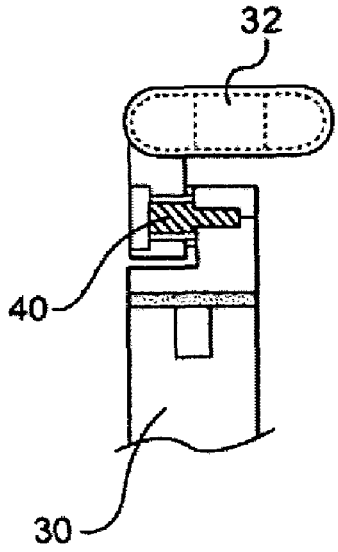
FIG. 7 is a further detailed view of a portion of the armrest of the preferred embodiment of the present invention.
Figure 8:
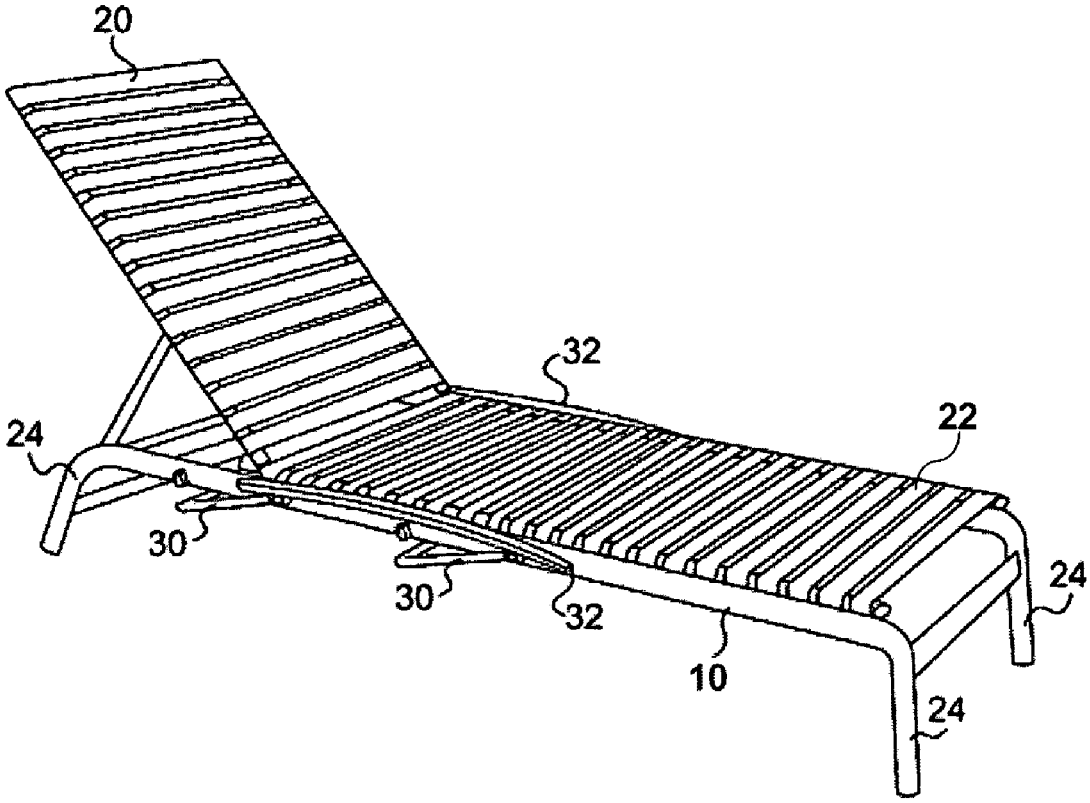
FIG. 8 is a perspective view of the present invention.
Figure 9:
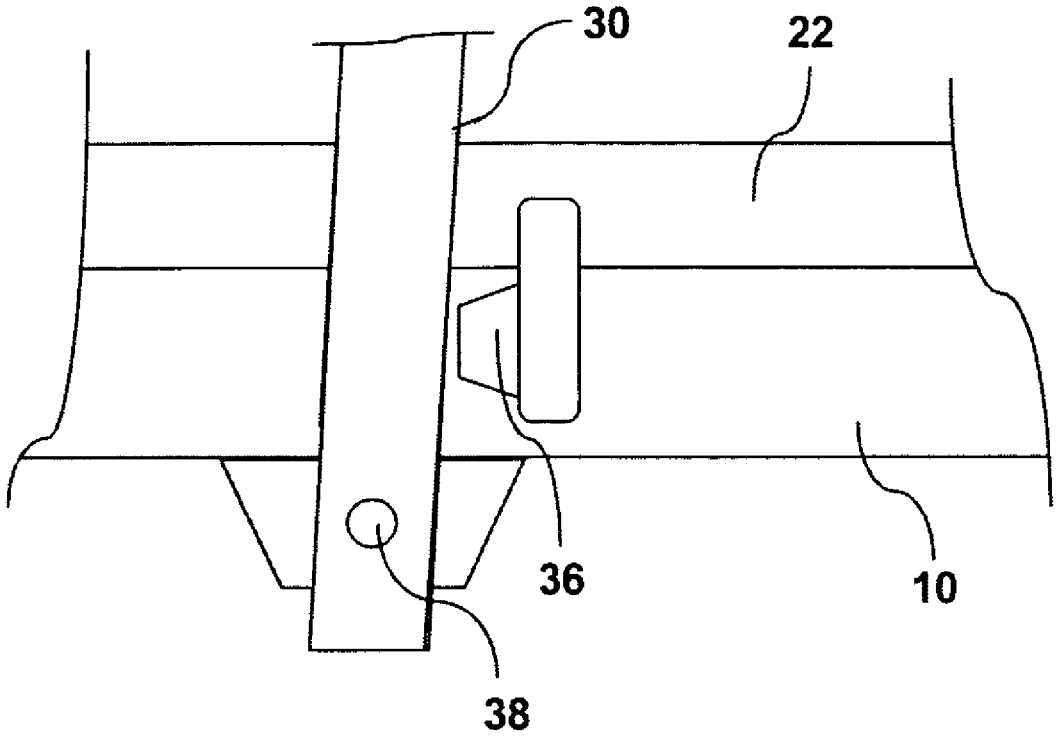
FIG. 9 is a detail side view of a stop and a portion of the armrest of the present invention.

As discussed previously, the vertical elements 30 of the armrests 26 are preferably pivotally connected to the horizontal element 32 and the seat portion 22. The preferred constructions for these connections are shown in detail in FIGS. 6 and 7. FIG. 6 shows the connection between the lower end of the vertical element 30 and the seat portion 22. In this preferred embodiment, the vertical element 30 is bolted to the seat portion 22 in a manner that allows rotation about the bolt 38. Similarly, as shown in FIG. 7, the upper end of the vertical element 30 is bolted 40 to the horizontal element 32 in a manner which allows rotation about the bolt 40. As shown in FIGS. 5, 6 and 9, stops 36 are positioned on frame 10 higher than bolts 38 so as to interrupt the pivotal or rotary movement of vertical element 30 at a point on vertical element 30 between bolt 38 and bolt 40, which is not only convenient for construction purposes but also reduces the force on bolt 38, when the armrests 26 are in the fully raised position.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A lounge chair, comprising:

a seat portion comprising a seat frame and material, which at least partially covers and is suspended by the seat frame;

a back portion adjacent to the seat portion and capable of being placed in a vertical orientation, wherein the back portion comprises a back frame and material, which at least partially covers and is suspended by the back frame;

a plurality of legs which support the seat and back portions;

at least one armrest comprising a substantially horizontal upper member and at least one substantially vertical support member pivotally mounted to the seat frame and pivotally supporting the upper member, wherein the armrest is movable between a first position above the seat portion and a second position lower in height than the first position, the orientation of the armrest being independent of the orientation of the back portion; and at least one stop positioned on the seat frame above and to the rear of the mount of the vertical support member;

wherein the stop is configured such that when the armrest is in the first position the vertical support member is held slightly past the vertical position toward the rear of the chair by resting on the stop such that force placed on the armrest is distributed between the stop and the pivot; and to lower the armrest to the second position, the armrests are moved forward toward the front of the chair.

2. The lounge chair as set forth in claim 1, wherein the seat portion is substantially horizontally oriented.

3. The lounge chair as set forth in claim 1, wherein the back portion is adjustable between a substantially vertical orientation and a substantially horizontal orientation.

4. The lounge chair as set forth in claim 1, further comprising two armrests.

5. The lounge chair as set forth in claim 1, further comprising two armrests and at least one horizontal member which connects the two armrests.

6. The lounge chair as set forth in claim 1, further comprising at least one stop element positioned on the seat frame which prevents movement of each at least one armrest beyond the second position.

7. The lounge chair as set forth in claim 1, wherein the plurality of legs are extensions of said seat frame.

8. The lounge chair as set forth in claim 1, wherein the material is in the form of straps.

9. The lounge chair as set forth in claim 1, wherein the material is fabric.

10. The lounge chair as set forth in claim 1, wherein the material is in the form of sheets.

11. The lounge chair as set forth in claim 1, wherein the material is in the form of rigid slats.

12. A lounge chair, comprising:

a frame;

a seat portion comprising seat material, which at least partially covers a portion of the frame, wherein the seat material is suspended by the frame;

a back portion adjacent to the seat portion and capable of being placed in a vertical orientation, wherein the back portion comprises a back frame and material, which at least partially covers the back frame, and wherein the back portion is pivotally mounted on and suspended by the frame;

a plurality of legs which support the frame;

at least one armrest comprising an upper member and at least one substantially vertical support member pivotally mounted to the frame and pivotally supporting the upper member, wherein the armrest is movable between a first position above the seat portion and a second position lower in height than the first position, the orientation of the armrest being independent of the orientation of the back portion; and at least one stop positioned on the frame above and to the rear of the mount of the vertical support member;

wherein the stop is configured such that when the armrest is in the first position the vertical support member is held slightly past the vertical position toward the rear of the chair by resting on the stop such that force placed on the armrest is distributed between the stop and the pivot; and to lower the armrest to the second position, the armrests are moved forward toward the front of the chair.

13. The lounge chair as set forth in claim 12, wherein the seat portion is substantially horizontally oriented.

14. The lounge chair as set forth in claim 12, wherein the back portion is adjustable between a substantially vertical orientation and a substantially horizontal orientation.

15. The lounge chair as set forth in claim 12, further comprising two armrests.

16. The lounge chair as set forth in claim 12, further comprising two armrests and at least one horizontal member which connects the two armrests.

17. The lounge chair as set forth in claim 12, further comprising at least one stop element positioned on the frame which prevents movement of each at least one armrest beyond the second position.

18. The lounge chair as set forth in claim 12, wherein the plurality of legs are extensions of said frame.

19. The lounge chair as set forth in claim 12, wherein the seat material and the back material are in the form of straps.

20. The lounge chair as set forth in claim 12, wherein the seat material and the back material are fabric.

21. The lounge chair as set forth in claim 12, wherein the seat material and the back material are in the form of sheets.

22. The lounge chair as set forth in claim 12, wherein the seat material and the back material are in the form of slats.

* * * * *